US009218761B2

(12) United States Patent
Umezaki et al.

(10) Patent No.: US 9,218,761 B2
(45) Date of Patent: Dec. 22, 2015

(54) METHOD OF DRIVING DISPLAY DEVICE, DISPLAY DEVICE, AND ELECTRONIC APPLIANCE

(71) Applicant: Semiconductor Energy Laboratory Co., Ltd., Kanagawa-ken (JP)

(72) Inventors: Atsushi Umezaki, Kanagawa (JP); Ryo Arasawa, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 14/335,210

(22) Filed: Jul. 18, 2014

(65) Prior Publication Data

US 2014/0327662 A1 Nov. 6, 2014

Related U.S. Application Data

(63) Continuation of application No. 12/906,539, filed on Oct. 18, 2010, now Pat. No. 8,786,527.

(30) Foreign Application Priority Data

Oct. 20, 2009 (JP) ..... 2009-241710

(51) Int. Cl.
*G09G 3/22* (2006.01)
*G09G 3/32* (2006.01)

(52) U.S. Cl.
CPC ..... *G09G 3/22* (2013.01); *G09G 3/3233* (2013.01); *G09G 3/3266* (2013.01); *G09G 2300/0465* (2013.01); *G09G 2300/0819* (2013.01); *G09G 2310/0251* (2013.01); *G09G 2310/0262* (2013.01); *G09G 2310/0264* (2013.01); *G09G 2310/061* (2013.01)

(58) Field of Classification Search
CPC ..... G09G 3/22; G09G 3/3233; G09G 2310/0264; G09G 2300/0465; G09G 2310/0251; G09G 2300/0819; G09G 2310/061; G09G 2310/0262; G09G 3/3266
See application file for complete search history.

(56) References Cited

U.S. PATENT DOCUMENTS

| | | | |
|---|---|---|---|
| 5,686,932 | A | 11/1997 | Tomita |
| 5,764,321 | A | 6/1998 | Koyama et al. |
| 6,841,948 | B2 | 1/2005 | Yoshida |
| 7,317,433 | B2 | 1/2008 | Chen et al. |

(Continued)

FOREIGN PATENT DOCUMENTS

| | | | |
|---|---|---|---|
| EP | 1 793 366 | A2 | 6/2007 |
| JP | 2004-117648 | A | 4/2004 |

(Continued)

*Primary Examiner* — Liliana Cerullo
(74) *Attorney, Agent, or Firm* — Husch Blackwell LLP

(57) ABSTRACT

The present invention is a method of driving a display device including a transistor, a capacitor one electrode of which is electrically connected to a first terminal of the transistor and the other electrode of which is electrically connected to a gate of the transistor, and a display element a first electrode of which is electrically connected to a second terminal of the transistor, including the steps of: electrically connecting the gate of the transistor, the first terminal of the transistor, and both electrodes of the capacitor to a first line in a first period; electrically connecting the gate of the transistor and the other electrode of the capacitor to a second line in a second period; and electrically connecting the first terminal of the transistor and one electrode of the capacitor to a third line in a third period.

9 Claims, 12 Drawing Sheets

(56) References Cited

U.S. PATENT DOCUMENTS

| | | | |
|---|---|---|---|
| 7,443,367 | B2 | 10/2008 | Numao |
| 7,595,778 | B2 | 9/2009 | Osame et al. |
| 7,817,117 | B2 | 10/2010 | Kimura |
| 7,932,888 | B2 | 4/2011 | Miyake |
| 8,022,911 | B1 | 9/2011 | Fan |
| 8,188,946 | B2 | 5/2012 | Nathan et al. |
| 8,289,239 | B2 | 10/2012 | Tanikame et al. |
| 8,305,304 | B2 | 11/2012 | Kimura |
| 8,325,111 | B2 | 12/2012 | Kimura |
| 8,477,085 | B2 | 7/2013 | Shishido |
| 8,487,923 | B2 | 7/2013 | Kimura |
| 8,749,595 | B2 | 6/2014 | Nathan et al. |
| 2002/0047822 | A1 | 4/2002 | Senda et al. |
| 2002/0196208 | A1 | 12/2002 | Nanno et al. |
| 2003/0103022 | A1 | 6/2003 | Noguchi et al. |
| 2004/0155873 | A1 | 8/2004 | Miyazawa |
| 2007/0152921 | A1* | 7/2007 | Osame ..... 345/76 |
| 2008/0225061 | A1 | 9/2008 | Kimura et al. |
| 2009/0058771 | A1 | 3/2009 | Toyomura et al. |
| 2009/0102752 | A1 | 4/2009 | Honda |
| 2009/0219232 | A1 | 9/2009 | Choi |
| 2013/0092963 | A1 | 4/2013 | Kimura |
| 2014/0232623 | A1 | 8/2014 | Nathan et al. |

FOREIGN PATENT DOCUMENTS

| | | | |
|---|---|---|---|
| JP | 2006-071919 | A | 3/2006 |
| JP | 2006-317923 | A | 11/2006 |
| JP | 2007-179041 | A | 7/2007 |
| JP | 2008-282047 | A | 11/2008 |
| JP | 2009-508168 | | 2/2009 |
| JP | 2009-122657 | A | 6/2009 |
| WO | WO 2007/030927 | A1 | 3/2007 |

* cited by examiner

METHOD OF DRIVING DISPLAY DEVICE, DISPLAY DEVICE, AND ELECTRONIC APPLIANCE

This application is a continuation of copending U.S. application Ser. No. 12/906,539, filed on Oct. 18, 2010 which is incorporated herein by reference.

BACKGROUND OF THE INVENTION

1. Field of the Invention

Field of the invention relates to a method of driving a display device, a display device, and an electronic appliance, and the like.

2. Description of the Related Art

Various types of pixel circuit of a display device have been proposed in, for example, Patent Documents 1 and 2.

REFERENCE

[Patent Document 1] Japanese Published Patent Application No. 2006-317923

[Patent Document 2] Japanese Published Patent Application No. 2009-122657

SUMMARY OF THE INVENTION

However, the threshold voltage of a transistor electrically connected to a display element in each pixel circuit of a display device varies among the pixel circuits in some cases.

In view of this, an object of the present invention is to reduce the influence of such variations in the threshold voltage of the transistor.

A display device and the method of driving the display device which solve the above problem will be described below.

One embodiment of the present invention is a display device including a display element, a transistor, and a capacitor.

One embodiment of the present invention is the method of driving a display device in which a display element is electrically connected to a first terminal of a transistor, and a capacitor is electrically connected between a gate of the transistor and a second terminal of the transistor.

One embodiment of the present invention is a method of driving a display device including a transistor, a capacitor one electrode of which is electrically connected to a first terminal of the transistor and the other electrode of which is electrically connected to a gate of the transistor, and a display element a first electrode of which is electrically connected to a second terminal of the transistor, including the steps of: electrically connecting the gate of the transistor, the first terminal of the transistor, and both electrodes of the capacitor to a first line in a first period; electrically connecting the gate of the transistor and the other electrode of the capacitor to a second line in a second period; and electrically connecting the first terminal of the transistor and one electrode of the capacitor to a third line in a third period.

One embodiment of the present invention is a method of driving a display device including a transistor, a capacitor one electrode of which is electrically connected to a first terminal of the transistor and the other electrode of which is electrically connected to a gate of the transistor, and a display element a first electrode of which is electrically connected to a second terminal of the transistor, including the steps of electrically connecting the gate of the transistor, the first terminal of the transistor, and both electrodes of the capacitor to a second line in a first period; electrically connecting the gate of the transistor and the other electrode of the capacitor to the second line in a second period; and electrically connecting the first terminal of the transistor and one electrode of the capacitor to a third line in a third period.

One embodiment of the present invention is a method of driving a display device including a transistor, a capacitor one electrode of which is electrically connected to a first terminal of the transistor and the other electrode of which is electrically connected to a gate of the transistor, and a display element a first electrode of which is electrically connected to a second terminal of the transistor, including the steps of: electrically connecting the gate of the transistor, the first terminal of the transistor, and both electrodes of the capacitor to a third line in a first period; electrically connecting the gate of the transistor and the other electrode of the capacitor to a second line in a second period; and electrically connecting the first terminal of the transistor and one electrode of the capacitor to the third line in a third period.

One embodiment of the present invention is a method of driving a display device including a transistor, a capacitor one electrode of which is electrically connected to a first terminal of the transistor and the other electrode of which is electrically connected to a gate of the transistor, a display element a first electrode of which is electrically connected to a second terminal of the transistor, a first switch electrically connected between the gate of the transistor and a second line, a second switch electrically connected between the gate of the transistor and the first terminal of the transistor, a third switch electrically connected to the first terminal of the transistor and a first line, and a fourth switch electrically connected to the first terminal of the transistor and a third line, including the steps of: bringing the first switch into an off, the second switch into an on state, the third switch into the on state, and the fourth switch into the off state in a first period; bringing the first switch into the on state, the second switch into the off state, the third switch into the off state, and the fourth switch into the off state in a second period; and bringing the first switch into the off state, the second switch into the off state, the third switch into the off state, and the fourth switch into the on state in a third period.

One embodiment of the present invention is a method of driving a display device including a transistor, a capacitor one electrode of which is electrically connected to a first terminal of the transistor and the other electrode of which is electrically connected to a gate of the transistor, a display element a first electrode of which is electrically connected to a second terminal of the transistor, a first switch electrically connected between the gate of the transistor and a second line, a second switch electrically connected between the gate of the transistor and the first terminal of the transistor, a third switch electrically connected to the first terminal of the transistor and the second line, and a fourth switch electrically connected to the first terminal of the transistor and a third line, including the steps of: bringing the first switch into an off, the second switch into an on state, the third switch into the on state, and the fourth switch into the off state in a first period; bringing the first switch into the on state, the second switch into the off state, the third switch into the off state, and the fourth switch into the off state in a second period; and bringing the first switch into the off state, the second switch into the off state, the third switch into the off state, and the fourth switch into the on state in a third period.

One embodiment of the present invention is a method of driving a display device including a transistor, a capacitor one electrode of which is electrically connected to a first terminal of the transistor and the other electrode of which is electrically connected to a gate of the transistor, a display element a first electrode of which is electrically connected to a second terminal of the transistor, a first switch electrically connected between the gate of the transistor and a second line, a second switch electrically connected between the gate of the transistor and the first terminal of the transistor, and a fourth switch electrically connected to the first terminal of the transistor and a third line, including the steps of: bringing the first switch into an off, the second switch into an on state, and the fourth switch into the on state in a first period; bringing the first switch into the on state, the second switch into the off state, and the fourth switch into the off state in a second period; and bringing the first switch into the off state, the second switch into the off state, and the fourth switch into the on state in a third period.

In the method of driving a display device which is one embodiment of the present invention, the switches are transistors.

In the method of driving a display device which is one embodiment of the present invention, the switches are diodes.

In the method of driving a display device which is one embodiment of the present invention, the display elements are EL elements.

In the method of driving a display device which is one embodiment of the present invention, the display devices are liquid crystal elements.

In the method of driving a display device which is one embodiment of the present invention, an electrode of the display element is larger than an electrode of the capacitor, and capacitance of the display element is larger than capacitance of the capacitor.

In the method of driving a display device which is one embodiment of the present invention, the transistors are p-channel transistors.

One embodiment of the present invention is a display device using the above method of driving a display device.

One embodiment of the present invention is an electronic appliance including the above display device.

One embodiment of the present invention is a display device including: a transistor; a capacitor one electrode of which is electrically connected to a first terminal of the transistor and the other electrode of which is electrically connected to a gate of the transistor; a display element a first electrode of which is electrically connected to a second terminal of the transistor; a first switch electrically connected between the gate of the transistor and a second line; a second switch electrically connected between the gate of the transistor and the first terminal of the transistor; a third switch electrically connected to the first terminal of the transistor and a first line; and a fourth switch electrically connected to the first terminal of the transistor and a third line.

One embodiment of the present invention is a display device including: a transistor; a capacitor one electrode of which is electrically connected to a first terminal of the transistor and the other electrode of which is electrically connected to a gate of the transistor; a display element a first electrode of which is electrically connected to a second terminal of the transistor; a first switch electrically connected between the gate of the transistor and a second line; a second switch electrically connected between the gate of the transistor and the first terminal of the transistor; a third switch electrically connected to the first terminal of the transistor and the second line; and a fourth switch electrically connected to the first terminal of the transistor and a third line.

One embodiment of the present invention is a display device including: a transistor; a capacitor one electrode of which is electrically connected to a first terminal of the transistor and the other electrode of which is electrically connected to a gate of the transistor; a display element a first electrode of which is electrically connected to a second terminal of the transistor; a first switch electrically connected between the gate of the transistor and a second line; a second switch electrically connected between the gate of the transistor and the first terminal of the transistor; and a fourth switch electrically connected to the first terminal of the transistor and a third line.

In the display device which is one embodiment of the present invention, the switches are transistors.

In the display device which is one embodiment of the present invention, the switches are diodes.

In the display device which is one embodiment of the present invention, the display elements are EL elements.

In the display device which is one embodiment of the present invention, the display devices are liquid crystal elements.

In the display device which is one embodiment of the present invention, an electrode of the display element is larger than an electrode of the capacitor, and capacitance of the display element is larger than capacitance of the capacitor.

In the display device which is one embodiment of the present invention, the transistors are p-channel transistors.

One embodiment of the present invention is an electronic appliance using the above display device.

The above display device and the method of driving the display device makes it possible to reduce variations among pixel circuits in threshold voltage of a transistor electrically connected to a display element which is in each pixel circuit of a display device.

DETAILED DESCRIPTION OF THE INVENTION

Although a display device according to the present invention includes a plurality of pixel circuits, a single pixel circuit of the display device will be described below.

Embodiment 1

In this embodiment, an example of the configuration of the pixel circuit of the display device and an example of the method of driving the display device is described.

Figure 1A:
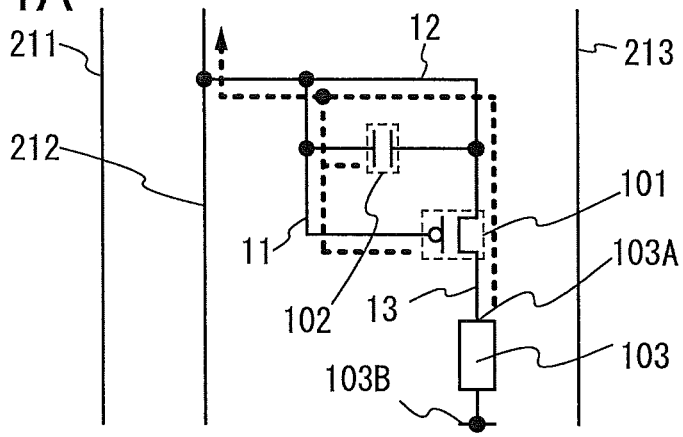
FIGS. 1A to 1C show an example of the method of driving a display device.
Figure 1B:
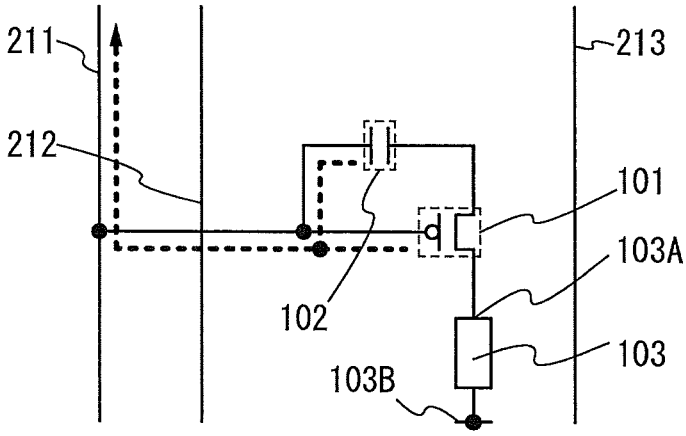
Figure 1C:
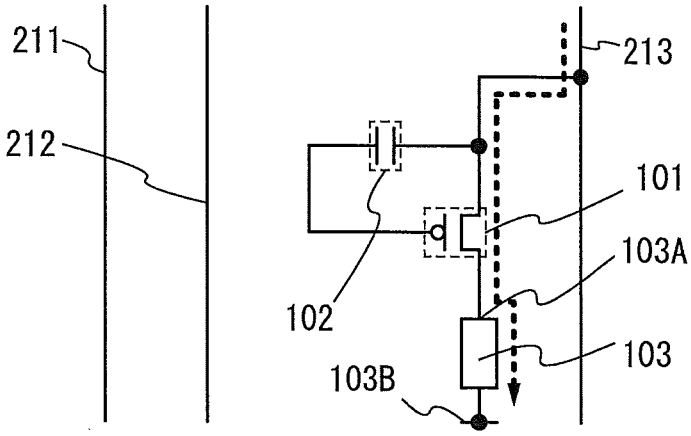

Description will be made with reference to FIGS. 1A to 1C. FIGS. 1A to 1C are examples of the schematic view showing the behavior of the display device according to the present invention. FIG. 1A is an example of the schematic view showing the behavior of the display device being initialized. FIG. 1B is an example of the schematic view showing the behavior of the display device to which a video signal is input. FIG. 1C is an example of the schematic view showing the behavior of the display device displaying an image in accordance with a video signal.

The display device according to the present invention includes a transistor 101, a capacitor 102, and a display element 103, for example. An example of this embodiment, however, is not limited to this. For example, the display device of this embodiment can additionally include a switch, a transistor, a diode, and/or, a capacitor in order to achieve the behavior shown in FIGS. 1A to 1C.

The transistor 101 has a function of supplying a current to the display element 103, for example. The value of such a current corresponds to, for example, a potential difference (Vgs) between the gate and source of the transistor 101 in many cases. Thus, the transistor 101 can function as a driver transistor or current source, for example. An example of this embodiment, however, is not limited to this. For example, the transistor 101 can function as a switch.

Note that the transistor 101 is a p-channel transistor, for example. A p-channel transistor is turned on when a potential difference (Vgs) between a gate and a source is smaller than threshold voltage (Vth 101). An example of this embodiment, however, is not limited to this. For example, the transistor 101 can be an n-channel transistor. An n-channel transistor is turned on when a potential difference (Vgs) between a gate and a source is larger than threshold voltage (Vth 101).

In other words, when an n-channel transistor is used, the display device can be operated by setting the polarity of the potential in reverse to a display device using a p-channel transistor. In this case, the circuit configuration is changed as appropriate in order to obtain the reverse polarity of the potential to that in a circuit using a p-channel transistor.

Note that for example, a plurality of pixels included in the display device according to the present invention, are categorized by a plurality of color groups (e.g. red, blue, green, white, yellow, magenta, cyan, or the like). In this case, it is recommended that the channel width (W) and channel length (L) of the transistor 101 or the W/L ratio (the ratio of channel width to channel length) of the transistor 101 are varied among the pixels according to the color group. For example, compared to a green emitting EL element, a red (or blue) emitting EL element has low luminous efficiency in some cases. In these cases, it is recommended that the W/L ratio of the transistor 101 in a pixel belonging to a green group is smaller than that of the transistor 101 in a pixel belonging to a red (or blue) group. Thus, the value of a video signal and/or the potential of a line 212 do not need to be varied among the pixels according to the color group. This simplifies the configuration of a circuit (e.g. a source driver circuit) which inputs a video signal to the pixels or reduces the number of power sources or signals required for a circuit (e.g. a source driver circuit) which inputs a video signal to the pixels. An example of the display device according to the present invention is not limited to this. For example, in all the pixels, the channel width (W) and channel length (L) of the transistor 101 or the W/L ratio of the transistor 101 can be approximately the same.

A capacitor 102 has a function of holding a potential difference (Vgs) between the gate of the transistor 101 and the first terminal of the transistor 101, for example. Thus, the capacitor 102 functions as a storage capacitor, for example. An example of the display device according to the present invention, however, is not limited to this.

The display element 103 is sandwiched between a first electrode 103A and a second electrode 103B, for example. Examples of the display element 103 are a light emitting element such as an EL element, a liquid crystal element, and an element containing electronic ink, and the like. An example of the display device according to the present invention, however, is not limited to this. For example, the display element 103 can include three electrodes.

Note that the display device according to the present invention includes a plurality of pixels, for example. In this case, the second electrodes 103B in pixels are electrically connected to each other in many cases. Thus, the second electrode 103B functions as a common electrode, a counter electrode, or a cathode, for example. An example of the display device according to the present invention is not limited to this. For example, the second electrodes 103B can be electrically separated by the type or area of the pixel.

Note that voltage (V1), for example, is applied to the second electrode 103B. The voltage (V1) serves as common voltage or cathode voltage, for example. An example of the display device according to the present invention is not limited to this. For example, a signal can be input to the display element 103. Thus, the display element 103 can be reverse-biased.

Note that the first electrode 103A functions as a pixel electrode, for example. An example of this embodiment, however, is not limited to this. For example, assuming that the first electrode 103A is electrically connected to a capacitor, the first electrode 103A can function as one electrode of the capacitor.

The display device according to the present invention is electrically connected, for example, to a line 211, the line 212, and a line 213. An example of the display device according to the present invention is not limited to this. For example, the display device according to the present invention can be electrically connected, for example, to other lines (e.g. a power supply line, a scan line, or the like). For another example, any of the lines 211 to 213 can be omitted.

A signal (Vdata), for example, is input to the line 211. The signal (Vdata) serves as a video signal. Thus, the line 211 functions as a signal line, a video signal line, or a source signal line, for example. An example of the display device according to the present invention is not limited to this. For example, constant voltage can be applied to the line 211. Thus, the line 211 can function as a power supply line.

Note that the signal (Vdata) is an analog signal, for example. An example of this embodiment, however, is not limited to this. For example, the signal (Vdata) can be a digital signal. Thus, digital time grayscale can be achieved.

The voltage (Vref), for example, is applied to the line 212. The voltage (Vref) serves as a reference voltage, for example. Therefore, the line 212 functions as a power supply line or an initialization line, for example. An example of this embodiment, however, is not limited to this. For example, a signal can be input to the line 212. Therefore, the line 212 can serve as a signal line, for example.

Note that a voltage (Vref) is a value lower than a voltage (V1) (Vref<V1), for example. An example of the display device according to the present invention is not limited to this. For example, the voltage (Vref) is approximately the same value as the voltage (V1). This reduces the number of the types of voltage needed to drive the pixels of the display device according to the present invention.

A voltage (V2), for example, is applied to the line 213. The voltage (V2) serves as anode voltage, for example. Therefore, the line 213 functions as a power supply line or anode line, for example. An example of the display device according to the present invention is not limited to this. For example, a signal can be input to the line 213. Thus, the line 213 functions as a signal line, for example.

Note that the voltage (V2) is a value higher than the voltage (V1) (V2>V1), for example. An example of this embodiment, however, is not limited to this. For example, when the anode and cathode of the display element 103 are interchanged, the voltage (V2) can be a value lower than the voltage (V1).

Note that for example, the display device includes a plurality of pixels, and the plurality of pixels is categorized by a plurality of color groups (e.g. red, blue, green, white, yellow, magenta, cyan, or the like). In this case, it is recommended that the value of a voltage applied to the line 213 is varied among the pixels according to the color group. For example, compared to a green emitting EL element, a red (or blue) emitting EL element has low luminous efficiency in some cases. In these cases, it is recommended that a voltage applied to the line 211 that is electrically connected to a pixel belonging to the green group is lower than a voltage applied to the line 211 that is electrically connected to a pixel belonging to the red (or blue) group. Thus, the value of a video signal and/or the W/L ratio of the transistor do not need to be varied among the pixels according to the color group. This simplifies the configuration of a circuit (e.g. a source driver circuit) which inputs a video signal to the pixels. An example of the display device according to the present invention is not limited to this. For example, in all the pixels, the potential of the line 213 can be approximately the same.

Figure 2:
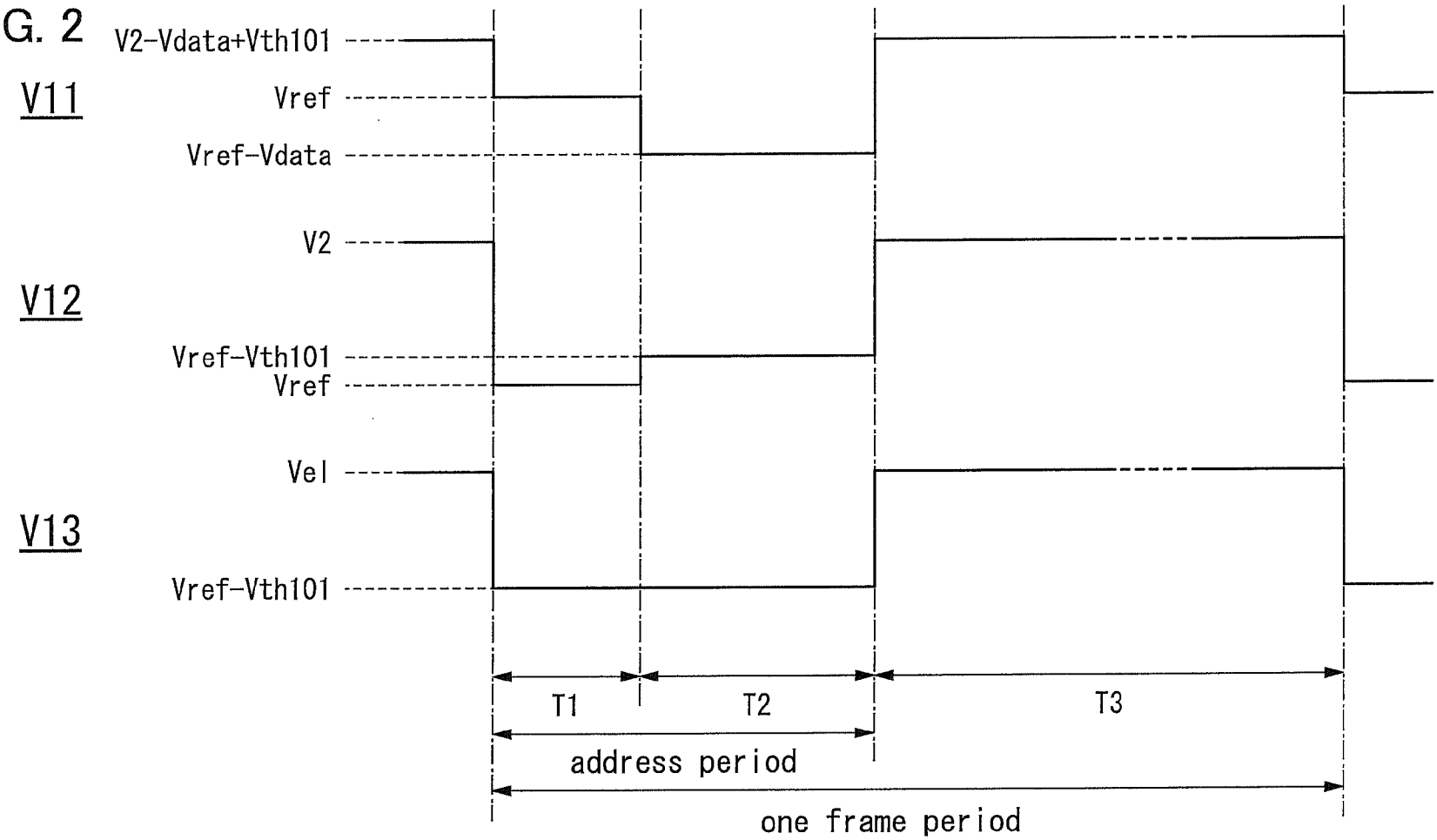
FIG. 2 shows an example of the timing chart regarding the method of driving a display device.

An example of the behavior of the display device according to the present invention will be described with reference to FIGS. 1A to 1C and FIG. 2. FIG. 2 is an example of the timing chart applicable to an example of the display device according to the present invention.

The timing chart shown in FIG. 2 includes a first period (T1), a second period (T2), and a third period (T3). In addition, the timing chart shown in FIG. 2 shows an example of the potential of a node 11 (V11), an example of the potential of a node 12 (V12), and an example of the potential of a node 13 (V13). Note that the node 11 is a point where the gate of the transistor 101 is electrically connected to a line or terminal other than the gate of the transistor 101. The node 12 is a point where the first terminal of the transistor 101 is electrically connected to a line or terminal other than the first terminal of the transistor 101. The node 13 is a point where the second terminal of the transistor 101 is electrically connected to a line or terminal other than the second terminal of the transistor 101.

First, in the first period (T1), the display device of this embodiment behaves as shown in FIG. 1A. Thus, the first period (T1) serves as an initialization period, for example. Note that the arrows shown in FIGS. 1A to 1C indicate the direction of current flow.

In FIG. 1A, electrical continuity between the first terminal of the transistor 101 and the gate of the transistor 101 is established. Electrical continuity between the gate of the transistor 101 and the line 212 is established. Electrical continuity between the second terminal of the transistor 101 and the first electrode 103A of the display element 103 is established. Electrical continuity between the first electrode of the capacitor 102 and the first terminal of the transistor 101 is established. Electrical continuity between the second electrode of the capacitor 102 and the gate of the transistor 101 is established. Note that electrical continuity between the first terminal of the transistor 101 and the line 213 is broken. Electrical continuity between the gate of the transistor 101 and the line 211 is broken. Thus, the potential of the gate of the transistor 101 (V11) and the potential of the first terminal of the transistor 101 (V12) become approximately the same value as the potential of the line 212 (Vref).

Then, the transistor 101 is turned on, so that the potential of the second terminal of the transistor 101 (V13) starts to decrease from Vel (a potential that depends on a current flowing through the display element 103 in the third period (T3) described later). The transistor 101 is turned off when the potential of the second terminal of the transistor 101 (V13) decreases to Vref−Vth101. Thus, the second terminal of the transistor 101 becomes floating, and the potential of the second terminal of the transistor 101 (V13) is held at Vref−Vth101. At that time, Vref−Vth101 is lower than the potential of the second electrode 103B of the display element 103, for example. Thus, the display element 103 functions as a capacitor, and thus holds a potential difference between the first electrode 103A and the second electrode 103B, i.e. a potential difference between the second terminal of the transistor 101 and the second electrode 103B (Vref−Vth101−V1). Consequently, the potential of the second terminal of the transistor 101 (V13) is held at Vref−Vth101. Note that Vth101 is the threshold voltage of the transistor 101.

Note that in the first period (T1), the potential of the second terminal of the transistor 101 (V13) is lower than the potential of the other electrode 103B of the display element 103 (V1). Hence, the display element 103 is reverse-biased. This suppresses degradation of the display element 103 and reduces defects, for example. An example of the display device according to the present invention is not limited to this. For example, the potential of the second terminal of the transistor 101 (V13) can be a value lower than the sum of the potential of the second electrode 103B of the display element 103 and the threshold voltage of the transistor 101.

Note that the transistor 101 is a normally-off transistor, for example. Hence, the threshold voltage of the transistor 101 (Vth101), which is a p-channel transistor, is a negative value. Note that an example of the display device according to the present invention is not limited to this. For example, the transistor 101 can be a normally-on transistor. In this case, in the first period (T1), the potential of the second terminal of the transistor 101 (V13) is approximately Vref.

Next, in the second period (T2), the display device according to the present invention behaves as shown in FIG. 1B. Thus, the second period (T2) serves as a write period, for example.

In FIG. 1B, electrical continuity between the gate of the transistor 101 and the line 211 is established. Electrical continuity between the second terminal of the transistor 101 and the first electrode 103A of the display element 103 is established. Electrical continuity between the first electrode of the capacitor 102 and the first terminal of the transistor 101 is established. Electrical continuity between the second electrode of the capacitor 102 and the gate of the transistor 101 remains established. Note that electrical continuity between the first terminal of the transistor 101 and the gate of the transistor 101 is broken. Electrical continuity between the first terminal of the transistor 101 and the line 213 is broken. Electrical continuity between the gate of the transistor 101 and the line 212 is broken.

The potential of the line 211 is a value lower than the potential of the line 212 (Vref) by Vdata (Vref−Vdata), for example. Hence, the potential of the gate of the transistor 101 (V11) becomes approximately the same value as the potential of the line 211 (Vref−Vdata). When an expression Vdata>0 is satisfied, the transistor 101 is turned on.

Consequently, electrical continuity between the first terminal of the transistor 101 and the second terminal of the transistor 101 is established, so that the potential of the first terminal of the transistor 101 (V12) becomes approximately the same value as the potential of the second terminal of the transistor 101 (V13). This value is determined by the capacitance of the capacitor 102 (C102) and the capacitance of the display element 103 (C103). Here, assuming that C102<C103, the potential of the first terminal of the transistor 101 (V12), and the potential of the second terminal of the transistor 101 (V13) each become approximately Vref−Vth101. Consequently, a potential difference between the gate and first terminal of the transistor 101 (Vth101−Vdata) is stored in the capacitor 102.

Note that at least an expression C102<C103 is satisfied, and preferably an expression C102<<C103 is satisfied. In other words, an approximation of the sum of C103 and C102 preferably is approximately C103.

In addition, the area of the electrode of the display element is larger than that of the electrode of the capacitor. Such a composition easily satisfies the expression C102<C103. Note that the area of each electrode of the display element and the capacitor refers to an area where a first electrode overlaps with a second electrode.

In addition, a combination of the first period (T1) and the second period (T2) is an address period.

Next, in the third period (T3), the display device according to the present invention behaves as shown in FIG. 1C. Thus, the third period (T3) serves as a display period, for example.

In FIG. 1C, electrical continuity between the first electrode of the transistor 101 and the line 213 is established. Electrical continuity between the second terminal of the transistor 101 and the first electrode 103A of the display element 103 remains established. Electrical continuity between the first electrode of the capacitor 102 and the first terminal of the transistor 101 remains established. Electrical continuity between the second electrode of the capacitor 102 and the gate of the transistor 101 remains established. Electrical continuity between the first terminal of the transistor 101 and the gate of the transistor 101 remains broken. Electrical continuity between the gate of the transistor 101 and the line 211 is broken. Electrical continuity between the gate of the transistor 101 and the line 212 is broken.

Consequently, the potential of the first terminal of the transistor 101 (V12) becomes approximately the same value as the potential of the line 213 (V2). At that time, the gate of the transistor 101 becomes floating, so that the potential of the gate of the transistor 101 (V11) increases to V2−Vdata+Vth101 because of capacitive coupling in the capacitor 102. This is because the capacitor 102 holds a potential difference between the gate of the transistor 101 and the first terminal of the transistor 101 in the second period (T2) (Vth101−Vdata). In other words, a potential difference between the gate and source of the transistor 101 (Vgs) remains Vth101−Vdata. Thus, when the transistor 101 operates in the saturation region, a drain current of the transistor 101 (a current that flows through the display element 103) is independent of the threshold voltage of the transistor 101. The threshold voltage of the transistor 101 can thus be canceled or compensated.

In the first period (T1) which is an initialization period, the potential of the electrodes of the capacitor 102, and the first terminal and gate of the transistor 101 is Vref. In addition, a potential difference that equals to the threshold voltage of the transistor 101 is given between the node 11 and the node 13. The first terminal (node 12) and gate (node 11) of the transistor 101 each have a potential (Vref), and the transistor 101 is thus turned off. Consequently, the second terminal (node 13) of the transistor 101 becomes floating, and the potential of the second terminal of the transistor 101 becomes Vref−Vth101. Therefore, a potential difference that equals to the threshold voltage of the transistor 101 (Vth101) is given between the node 11 and the node 13.

In other words, in the first period (T1), the potential of the electrodes of the capacitor 102 and the first terminal and gate of the transistor 101 is initialized to Vref, and a potential difference that equals to the threshold voltage of the transistor 101 (Vth101) is given between the node 11 and the node 13.

In the second period (T2) which is a write period, an input of the video signal (Vdata) is done. Consequently, the potential of the node 11 becomes Vref−Vdata, and a potential difference between the node 11 and the node 13 becomes Vth101−Vdata. Thus, the transistor 101 is turned on. This is because when the transistor 101 is turned on, the potential of the node 12 and the potential of the node 13 become approximately the same and charge enough to produce a potential difference that corresponds to Vth101−Vdata is stored in the capacitor 102. In other words, in the second period (T2), charge enough to turn on the transistor 101 during a display period without respect to the threshold voltage of the transistor 101 is stored in the capacitor 102.

In the third period (T3) which is a display period, current is fed into the display element. This is achieved because a potential difference (Vth101−Vdata) is given between the node 11 and the node 12 by the capacitor 102 and a potential difference that can turn on the transistor 101 without respect to the threshold voltage of the transistor 101 is given between the node 11 and the node 12. In other words, in the third period (T3), the transistor 101 is turned on without respect to the threshold voltage of the transistor 101, and thus supplied with current by the display element.

As described above, the display device according to the present invention can display an image without being influenced by variations in the threshold voltage of the transistor 101 or degradation of the transistor 101.

This embodiment can be combined with any of all the other embodiments.

Embodiment 2

Here, in each period, the display device according to the present invention can perform various behavior in addition to the behavior shown in FIGS. 1A to 1C. An example of the behavior of the display device according to the present invention other than the behavior shown in FIGS. 1A to 1C will be described below. Note that the arrows shown in FIGS. 3A and 3B indicate the direction of current flow.

Figure 3A:
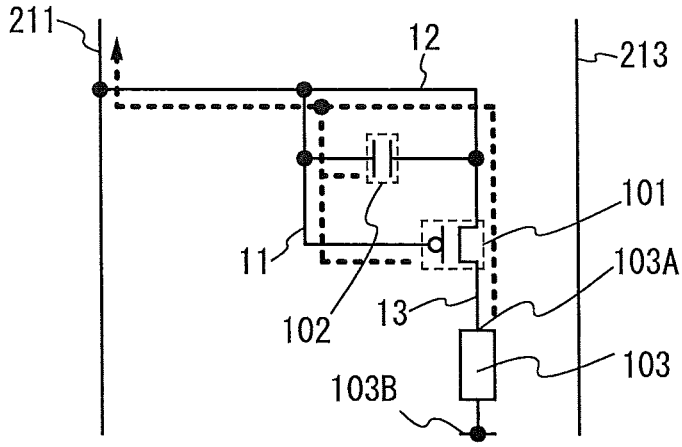
FIGS. 3A and 3B show an example of the method of driving a display device.

FIG. 3A is an example of the schematic view showing behavior different from that shown in FIG. 1A. The behavior shown in FIG. 3A is one whereby the display device is initialized and the threshold voltage of the transistor 101 in the display device is obtained (the behavior is performed in the first period (T1)). FIG. 3A is different from FIG. 1A in that it shows the case where electrical continuity between the gate of the transistor 101 and the line 211 is established and the line 212 is omitted. In addition, in the first period (T1), the potential of the line 211 is Vref. This enables the omission of the line 212, thereby improving the aperture ratio of a pixel, improving yield, and reducing manufacturing costs, for example.

Figure 3B:
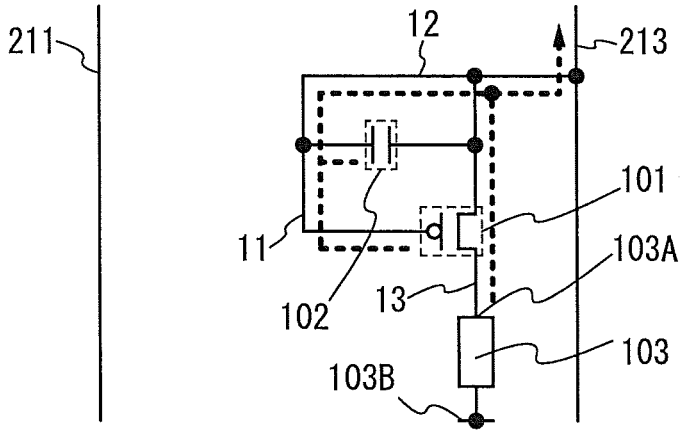

FIG. 3B is an example of the schematic view showing behavior different from that shown in FIG. 1A. The behavior shown in FIG. 3B is one whereby the display device is initialized and the threshold voltage of the transistor 101 in the display device is obtained (the behavior is performed in the first period (T1)). FIG. 3B is different from FIG. 1A in that it shows the case where electrical continuity between the gate of the transistor 101 and the line 213 is established and the line 212 is omitted. In addition, in the first period (T1), the potential of the line 213 is Vref. This enables the omission of the line 212, thereby improving the aperture ratio of a pixel, improving yield, and reducing manufacturing costs, for example.

Note that the behavior in the second period (T2) and third period (T3) shown in FIGS. 3A and 3B is similar to that in the second period (T2) and third period (T3) of Embodiment 1. Thus, in the second period (T2), the signal (Vdata) is input to the line 211. In the third period (T3), the voltage (V2) is applied to the line 213. Note that the voltage (Vref) is a value lower than the voltage (V1) (Vref<V1). In addition, the voltage (V2) is a value higher than the voltage (V1) (V2>V1). The signal (Vdata) serves as a video signal.

Note that when the display device according to the present invention performs the behavior shown in FIG. 3B, the line 213 preferably intersects the line 211 at right angles, for example. This enables pixels to be individually controlled, achieving line sequential drive. An example of the display device according to the present invention is not limited to this.

This embodiment can be combined with any of all the other embodiments.

Embodiment 3

Here, a display device according to the present invention can include a switch in order to achieve the above behavior of the display device. An example of the display device according to the present invention including a switch in order to achieve the above behavior of the display device will be described below.

Figure 4:
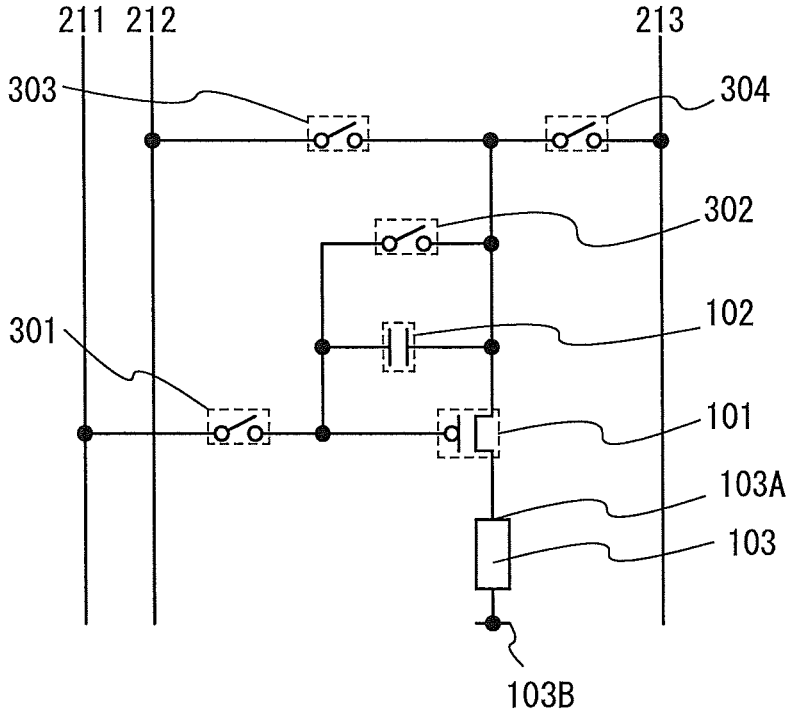
FIG. 4 shows an example of the configuration of a pixel circuit in a display device.

FIG. 4 shows an example of the display device that can achieve the behavior shown in FIG. 1A to 1C. A display device shown in FIG. 4 includes a switch 301, a switch 302, a switch 303, and a switch 304, in addition to the transistor 101, the capacitor 102, and the display element 103. The switch 301 is electrically connected between the gate of the transistor 101 and the line 211. The switch 302 is electrically connected between the gate of the transistor 101 and the first terminal of the transistor 101. The switch 303 is electrically connected between the first terminal of the transistor 101 and the line 212. The switch 304 is electrically connected between the first terminal of the transistor 101 and the line 213.

Figure 5A:
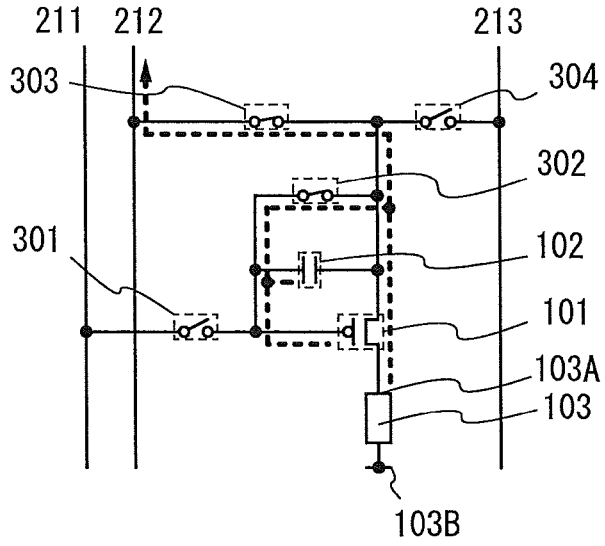
FIGS. 5A to 5C show an example of the method of driving a display device.
Figure 5B:
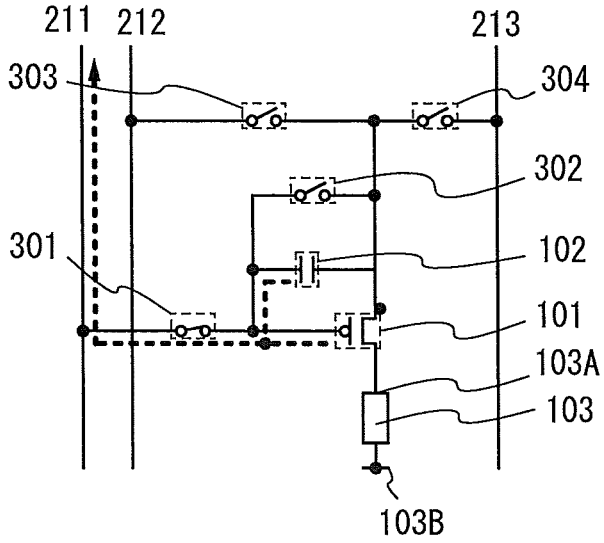
Figure 5C:
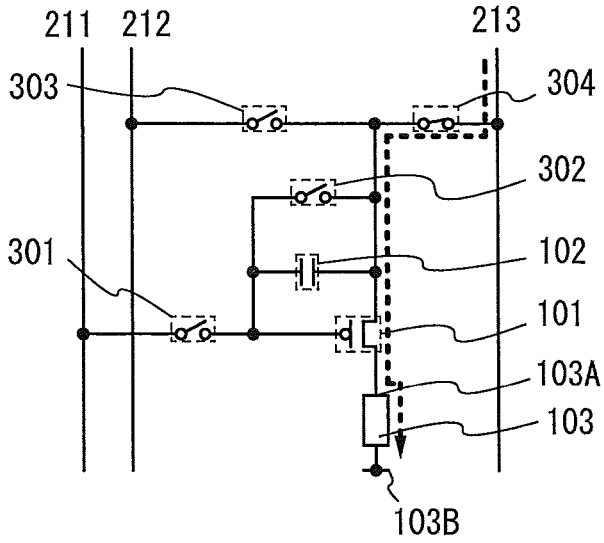

An example of the behavior of the display device shown in FIG. 4 will be described with reference to FIGS. 5A to 5C. Note that the arrows shown in FIGS. 5A to 5C indicate the direction of current flow. In the first period (T1), as shown in FIG. 5A, the switch 301 is turned off, the switch 302 is turned on, switch 303 is turned on, and the switch 304 is turned off. In the second period (T2), as shown in FIG. 5B, the switch 301 is turned on, the switch 302 is turned off, the switch 303 is turned off, and the switch 304 remains off. In the third period (T3), as shown in FIG. 5C, the switch 301 is turned on, the switch 302 is turned off, the switch 303 remains off, and the switch 304 is turned on. Thus, electrical continuity is controlled by on and off of the switches. This allows the display device shown in FIG. 4 to behave as shown in FIG. 1A to 1C.

Figure 6:
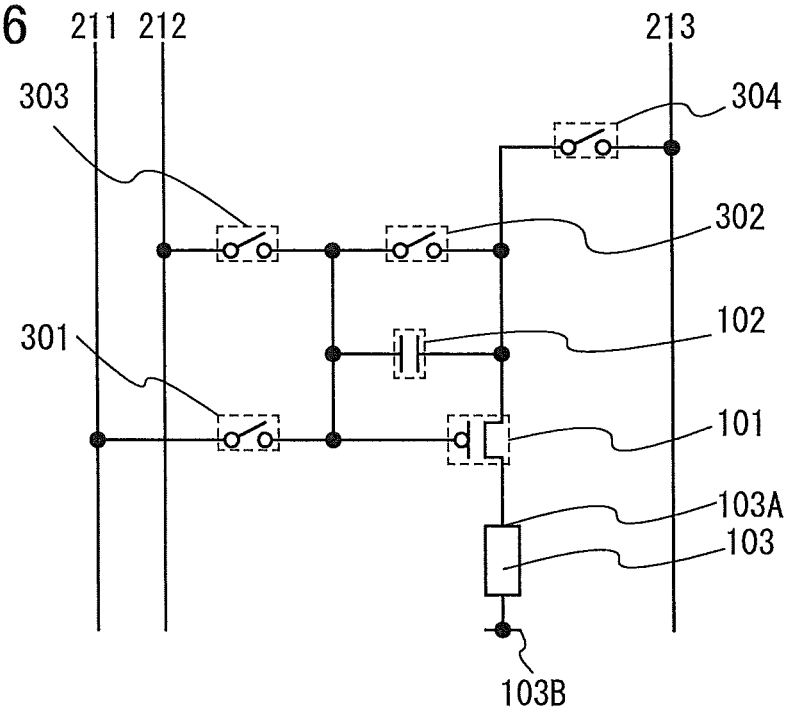
FIG. 6 shows an example of the configuration of a pixel circuit in a display device.

FIG. 6 shows an example of the display device that can perform the behavior shown in FIGS. 1A to 1C or FIG. 5A to 5C. This display device is different from that in FIG. 4. FIG. 6 is different from FIG. 4 in that it shows the case where the switch 303 is electrically connected between the gate of the transistor 101 and the line 212.

An example the behavior of the display device shown in FIG. 6 will be described. In the first period (T1), the switch 301 is turned off, the switch 302 is turned on, the switch 303 is turned on, and the switch 304 is turned off. In the second period (T2), the switch 301 is turned on, the switch 302 is turned off, the switch 303 is turned off, and the switch 304 remains off. In the third period (T3), the switch 301 is turned off, the switch 302 remains off, the switch 303 remains off, and the switch 304 is turned on. Thus, electrical continuity is controlled by on and off of the switches. This enables the behavior shown in FIG. 1A to 1C and FIGS. 5A to 5C.

Note that the behavior in the first to third periods (T1) to (T3) described with reference to FIG. 4, FIGS. 5A to 5C, and FIG. 6 is similar to that in the first to third periods (T1) to (T3) of Embodiment 1. Thus, in the first period (T1), the potential of the line 213 becomes Vref. In the second period (T2), the signal (Vdata) is input to the line 211. In the third period (T3), the voltage (V2) is applied to the line 213. Note that the voltage (Vref) is a value lower than the voltage (V1) (Vref<V1). In addition, the voltage (V2) is a value higher than the voltage (V1) (V2>V1). The signal (Vdata) serves as a video signal.

Figure 7A:
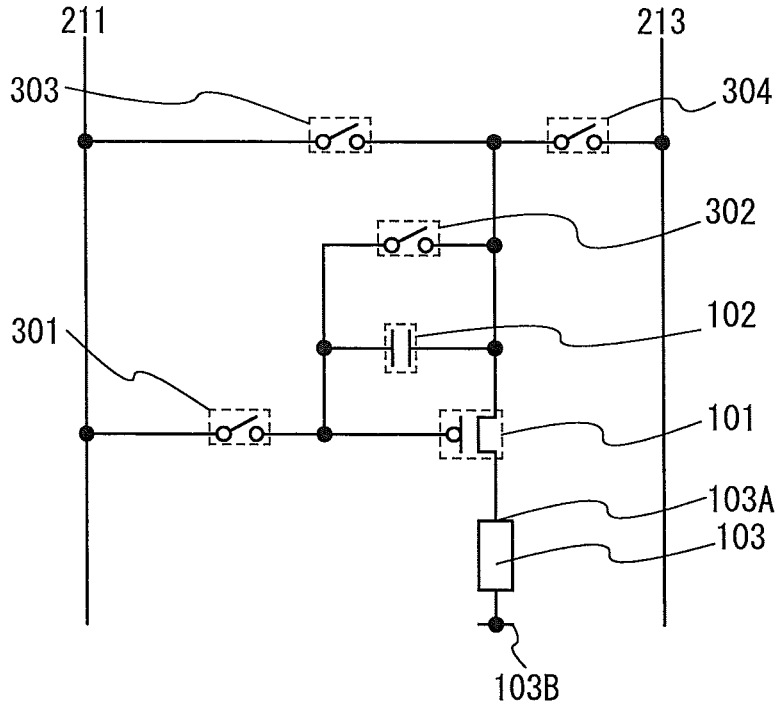
FIGS. 7A and 7B each show an example of the configuration of a pixel circuit in a display device.

FIG. 7A shows an example of the display device that can perform the behavior shown in FIG. 1A to 1C and FIGS. 3A and 3B. FIG. 7A is different from FIG. 4 in that it shows the case where the switch 303 is electrically connected between the first terminal of the transistor 101 and the line 211, and the line 212 is omitted. Since the line 212 is omitted, the aperture ratio of a pixel and yield are improved, and manufacturing costs is reduced, for example.

In this case, in the first period (T1), the switch 301 is turned off, the switch 302 is turned on, the switch 303 is turned on, and the switch 304 is turned off. In addition, the potential of the line 211 is preferably Vref in the first period (T1). In the second period (T2), the switch 301 is turned on, the switch 302 is turned off, the switch 303 is turned off, and the switch 304 is turned off. In the third period (T3), the switch 301 is turned off, the switch 302 is turned off, the switch 303 is turned off, and the switch 304 is turned on. An example of this embodiment, however, is not limited to this.

Alternatively, in the first period (T1), the switch 301 is turned off, the switch 302 is turned on, the switch 303 is turned off, and the switch 304 is turned on. In addition, the potential of the line 213 is preferably Vref in the first period (T1). In the second period (T2), the switch 301 is turned on, the switch 302 is turned off, the switch 303 is turned off, and the switch 304 is turned off. In the third period (T3), the switch 301 is turned off, the switch 302 is turned off, the switch 303 is turned off, and the switch 304 is turned on. An example of this embodiment, however, is not limited to this.

Figure 7B:
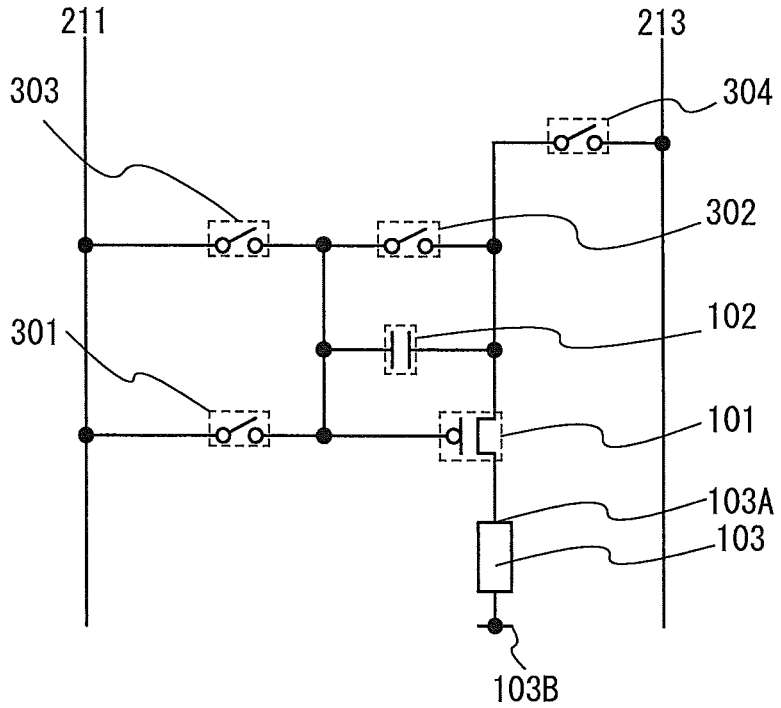

FIG. 7B shows an example of the display device that can perform the behavior shown in FIG. 1A to 1C and FIGS. 3A and 3B. FIG. 7B is different from FIG. 4 in that it shows the case where the switch 303 is electrically connected between the first gate of the transistor 101 and the line 211, and the line 212 is omitted. In addition, each of the switches 303 and 301 is electrically connected in parallel to the gate of the transistor 101. Since the line 212 is omitted, the aperture ratio of a pixel and yield are improved, and manufacturing costs is reduced, for example.

In this case, in the first period (T1), the switch 301 is turned off, the switch 302 is turned on, the switch 303 is turned on, and the switch 304 is turned off. Note that the switch 301 is not necessarily turned off at that time. In addition, the potential of the line 211 is preferably Vref in the first period (T1).

In the second period (T2), the switch 301 is turned on, the switch 302 is turned off, the switch 303 is turned off, and the switch 304 is turned off. Note that the switch 303 is not necessarily turned off at that time. In the third period (T3), the switch 301 is turned off, the switch 302 is turned off, the switch 303 is turned off, and the switch 304 is turned on. An example of this embodiment, however, is not limited to this.

Alternatively, in the first period (T1), the switch 301 is turned off, the switch 302 is turned on, the switch 303 is turned off, and the switch 304 is turned on. In addition, the potential of the line 213 is preferably Vref in the first period (T1). In the second period (T2), the switch 301 is turned on, the switch 302 is turned off, the switch 303 is turned off, and the switch 304 is turned off. Note that the switch 303 is not necessarily turned off at that time. In the third period (T3), the switch 301 is turned off, the switch 302 is turned off, the switch 303 is turned off, and the switch 304 is turned on. An example of this embodiment, however, is not limited to this.

Note that the behavior in the second period (T2) and third period (T3) shown in FIGS. 7A and 7B is similar to that in the second period (T2) and third period (T3) of Embodiment 1. Thus, in the second period (T2), the signal (Vdata) is input to the line 211. In the third period (T3), the voltage (V2) is applied to the line 213. Note that the voltage (Vref) is a value lower than the voltage (V1) (Vref<V1). In addition, the voltage (V2) is a value higher than the voltage (V1) (V2>V1). The signal (Vdata) serves as a video signal.

Figure 8:
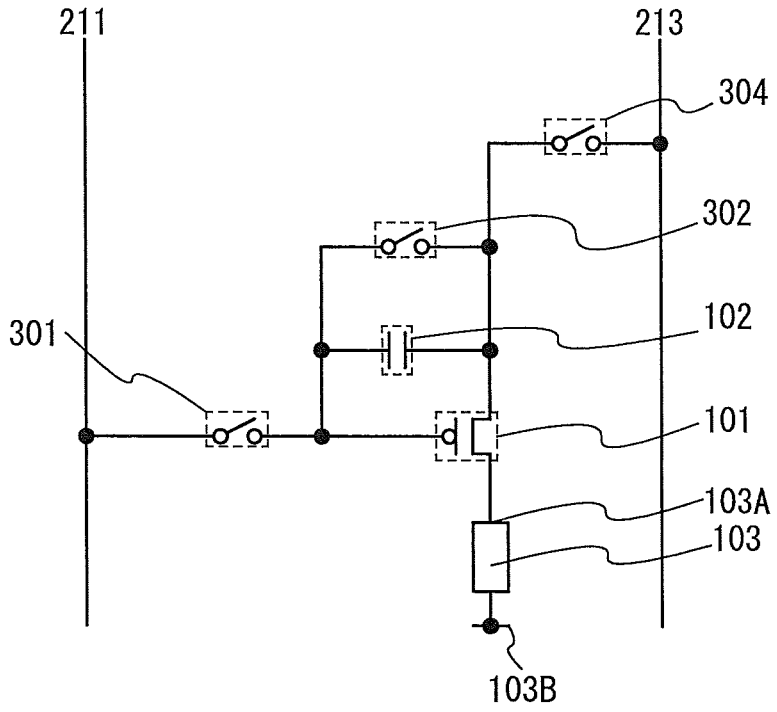
FIG. 8 shows an example of the configuration of a pixel circuit in a display device.

FIG. 8 shows an example of the display device that can perform the behavior shown in FIG. 1A to 1C and FIGS. 3A and 3B. FIG. 8 is different from FIG. 4 in that it shows the case where the switch 303 and the line 212 are omitted. Since the line 212 is omitted, the aperture ratio of a pixel and yield can be improved, and manufacturing costs is reduced, for example.

In this case, in the first period (T1), the switch 301 is turned off, the switch 302 is turned on, and the switch 304 is turned on. In addition, the potential of the line 213 is preferably Vref in the first period (T1). In the second period (T2), the switch 301 is turned on, the switch 302 is turned off, and the switch 304 is turned off. In the third period (T3), the switch 301 is turned off, the switch 302 is turned off, and the switch 304 is turned on. An example of this embodiment, however, is not limited to this.

Alternatively, in the first period (T1), the switch 301 is turned on, the switch 302 is turned on, and the switch 304 is turned off. In addition, the potential of the line 211 is preferably Vref in the first period (T1). In the second period (T2), the switch 301 is turned on, the switch 302 is turned off, and the switch 304 is turned off. In the third period (T3), the switch 301 is turned off, the switch 302 is turned off, and the switch 304 is turned on. An example of this embodiment, however, is not limited to this. For example, the switch 303 can be electrically connected between the first terminal of the transistor 101 and the line 213, or between the gate of the transistor 101 and the line 213.

Note that the behavior in the second period (T2) and third period (T3) shown in FIG. 8 is similar to that in the second period (T2) and third period (T3) of Embodiment 1. Thus, in the second period (T2), the signal (Vdata) is input to the line 211. In the third period (T3), the voltage (V2) is applied to the line 213. Note that the voltage (Vref) is a value lower than the voltage (V1) (Vref<V1). The voltage (V2) is a value higher than the voltage (V1) (V2>V1). The signal (Vdata) serves as a video signal.

Figure 9:
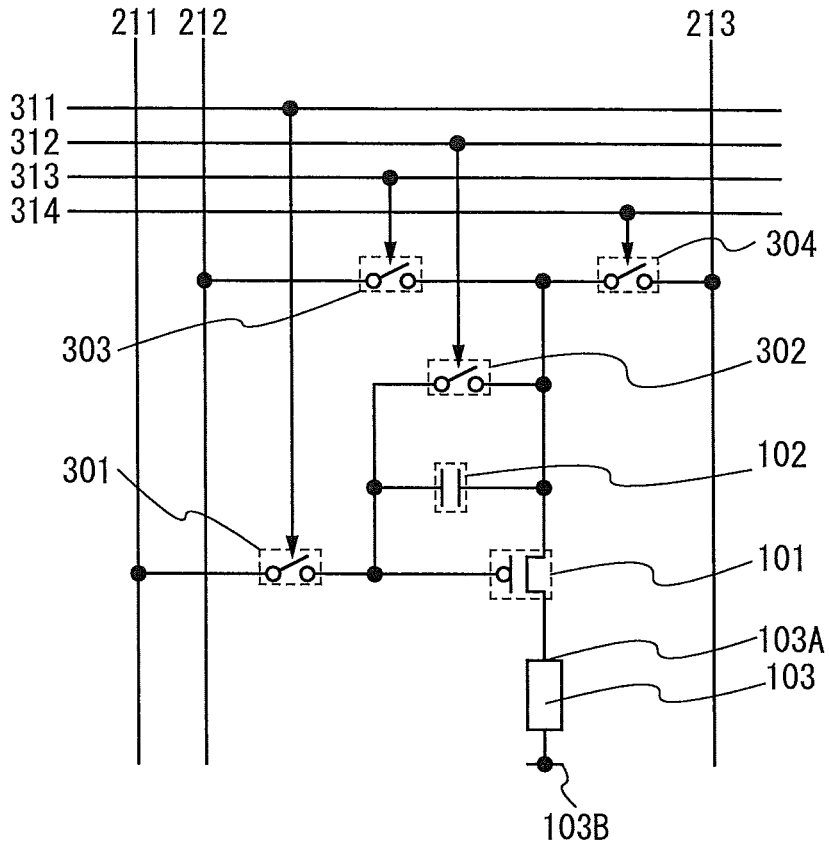
FIG. 9 shows an example of the configuration of a pixel circuit in a display device.
Figure 10:
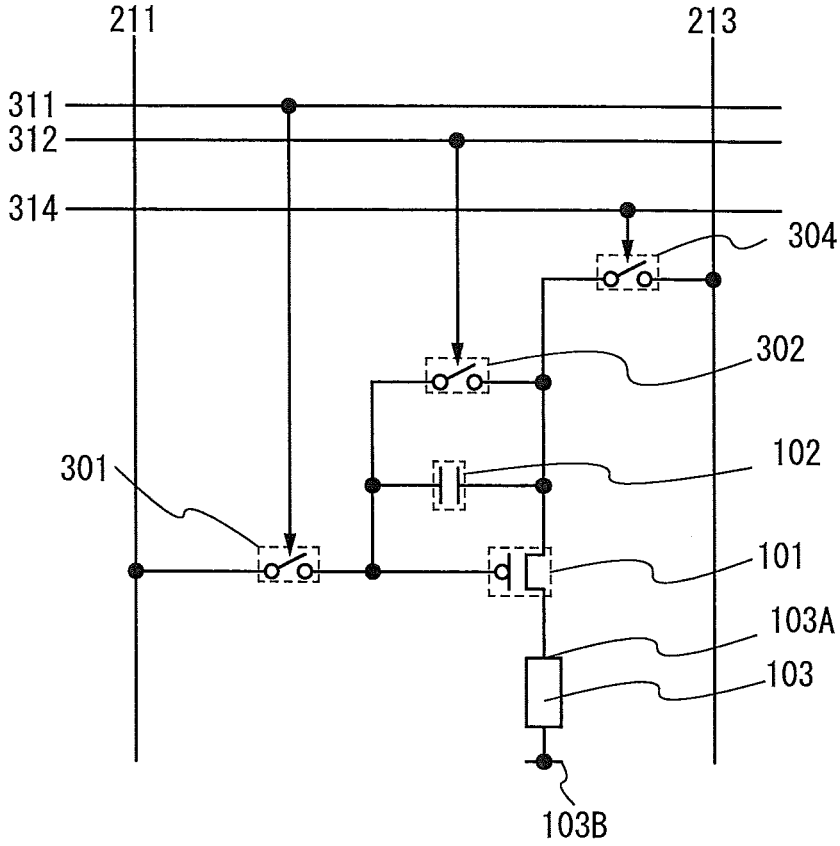
FIG. 10 shows an example of the configuration of a pixel circuit in a display device.

Note that, as shown in FIG. 9 and FIG. 10, the display device can be electrically connected to a plurality of lines. FIG. 9 shows an example of the display device shown in FIG. 4 that is electrically connected to a plurality of lines. Signals that control on and off of the switches 301 to 304, for example, are input to the lines 311 to 314, respectively.

FIG. 10 shows an example of the display device shown in FIG. 8 that is electrically connected to a plurality of lines. Signals that control on and off of the switches 301, 302, and 304, for example, are input to the lines 311, 312, and 314, respectively. As described above, the above display device can be provided with a plurality of lines.

The configurations which are shown in FIG. 9 and FIG. 10 are applicable when the switches 301, 302, and 304 are transistors.

In addition, a transistor or a diode, for example, is applicable to a switch of this embodiment. An example of this embodiment, however, is not limited to this. Any components having a switching function are applicable to a switch of this embodiment.

In addition, line sharing is possible as shown in FIGS. 7A and 7B and FIG. 8. Such line sharing improves the aperture ratio of a pixel and yield, and reduces manufacturing costs, for example. Line sharing in a pixel is not limited to that shown in FIGS. 7A and 7B and FIG. 8.

Figure 11:
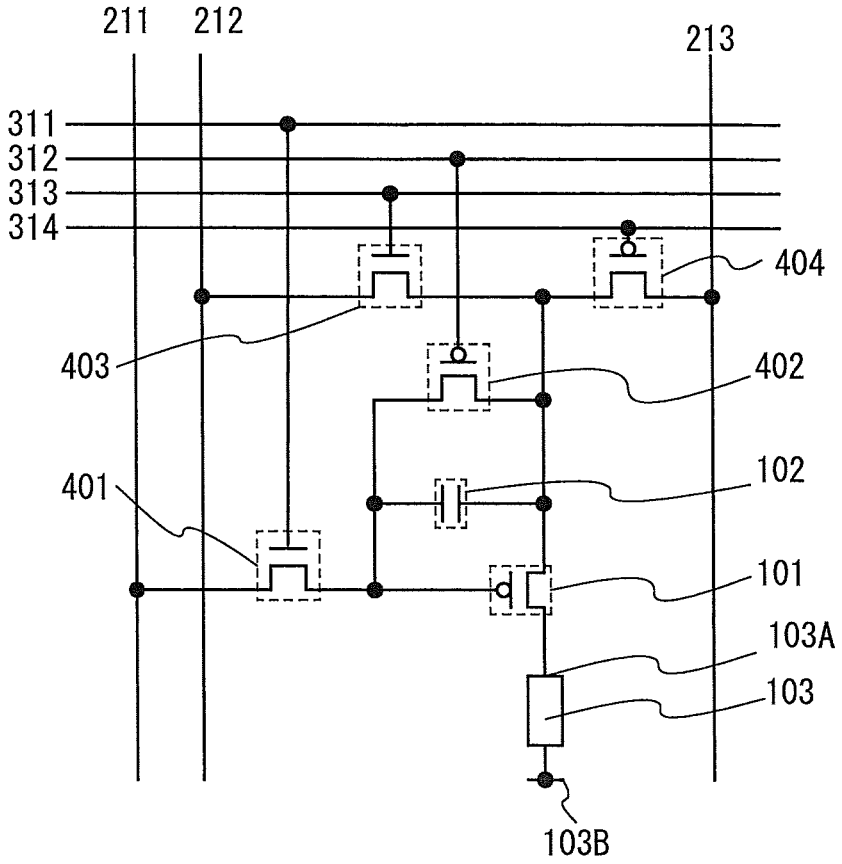
FIG. 11 shows an example of the configuration of a pixel circuit in a display device.

FIG. 11 shows an example of the display device shown in FIG. 10 in which each of the switches 301, 302, and 304 is replaced with a transistor. Transistors 401 and 403 are n-channel transistors, and transistors 402 and 404 are p-channel transistors.

The transistors 401 to 404 can be either n-channel transistors or p-channel transistors. In addition, the conductivity type of the transistors 401 to 404 can be different from that shown in FIG. 11. For example, the transistors 401 to 403 can be n-channel transistors, and the transistors 404 can be a p-channel transistor. The conductivity type of the transistors 401 to 404, however, is not limited this.

The configuration shown in FIG. 11 is similar to that shown in FIG. 10 except for the switches 301 to 304.

Note that a transistor electrically connected to the line 211 and 212 the potential of which is lower than the potential of the second electrode 103B exhibits favorable switching when being an n-channel transistor. In addition, a transistor electrically connected to the line 213 the potential of which is higher than the potential of the second electrode 103B exhibits favorable switching when being a p-channel transistor.

Although FIG. 11 shows an example of the case where each of the switches 301, 302, and 304 is replaced with a transistor, one embodiment of the present invention is not limited to this. For example, each of the switches 301, 302, and 304 can be a CMOS circuit which is a combination of a p-channel transistor and an n-channel transistor.

Although not shown, the switches 301 to 304 in FIG. 4, FIGS. 5A to 5C, FIG. 6, FIGS. 7A and 7B, and FIG. 9, and the switches 301, 302, and 304 in FIG. 8 and FIG. 10 can also be replaced, as in FIG. 11, with the transistors 401 to 404, respectively. In this case, the configuration or the conductivity type of the transistors is similar to that in FIG. 11.

In other words, as for the configuration of the transistor, each of the switches 301, 302, and 304 can be replaced with a transistor. Alternatively, the switches 301, 302, and 304 can be a CMOS circuit which is a combination of a p-channel transistor and an n-channel transistor. One embodiment of the present invention is not limited to this.

When each of the switches 301 to 304 is replaced with a transistor, the conductivity type of the transistors is as follows: the transistors 401 and 403 are n-channel transistors, the transistors 402 and 404 are p-channel transistors; alternatively, the transistors 401 to 404 are all n-channel transistors. One embodiment of the present invention is not limited to this.

This embodiment can be combined with any of all the other embodiments.

Embodiment 4

The configuration of a transistor used for the above display device will be described.

Note that various types of transistor can be used as a transistor included in the above display device. In other words, there is no limitation on the type of a transistor which can be used. Therefore, a thin film transistor including a semiconductor layer typified by silicon, a transistor formed using a semiconductor substrate or an SOI substrate, a MOS transistor, a junction transistor, a bipolar transistor, a transistor including a compound semiconductor such as ZnO or InGaZnO, a transistor including an organic semiconductor or carbon nanotube, or other transistors can be used. Note that the semiconductor layer may contain hydrogen or halogen.

In the case where a transistor included in the above display device is a thin film transistor, various types of thin film transistors can be used. For example, a top-gate TFT, e.g. a planar TFT, or a bottom-gate TFT (a typical example of which is an inverted staggered TFT) can be used. One embodiment of the present invention is not limited to this.

Various types of semiconductor layers can be used for the above display device. For example, a non-single-crystal silicon layer typically using amorphous silicon, polycrystalline silicon, microcrystalline (also referred to as micro crystal or semi-amorphous) silicon; single crystalline silicon layer; or an oxide semiconductor layer can be used.

As an oxide semiconductor layer, a thin film of a material expressed by $InMO_3(ZnO)_m$ (m>0) is formed, and a thin layer transistor having the thin film as an oxide semiconductor layer is fabricated. Note that M denotes a single metal element or a plurality of metal elements selected from Ga, Fe, Ni, Mn, and Co. For example, M might be Ga. In addition, M might be a plurality of elements: Ga and Ni or a plurality of elements: Ga and Fe, for example. Thus, M might include any of the above listed metal elements except Ga. Moreover, in some cases, the above oxide semiconductor contains a transition metal element such as Fe or Ni or an oxide of the transition metal as an impurity element in addition to a metal element M.

In the present invention, among the oxide semiconductor layers whose composition formulae are represented by $InMO_3(ZnO)_m$ (m>0), an oxide semiconductor whose composition formula includes at least Ga as M is referred to as an In—Ga—Zn—O-based oxide semiconductor, and a thin layer of the In—Ga—Zn—O-based oxide semiconductor is referred to as an In—Ga—Zn—O-based non-single-crystal layer. As a metal oxide used for the oxide semiconductor layer, any of the following metal oxides can be used in addition to the above: an In—Sn—O-based metal oxide; an In—Sn—Zn—O-based metal oxide; an In—Al—Zn—O-based metal oxide; a Sn—Ga—Zn—O-based metal oxide; an Al—Ga—Zn—O-based metal oxide; a Sn—Al—Zn—O-based metal oxide; an In—Zn—O-based metal oxide; a Sn—Zn—O-based metal oxide; an Al—Zn—O-based metal oxide; an In—O-based metal oxide; a Sn—O-based metal oxide; and a Zn—O-based metal oxide. Silicon oxide may be included in the oxide semiconductor layer formed using the above metal oxide.

In the case of the formation of a transistor included in the above display device, the transistor can be formed using a silicon wafer or an SOI substrate. One embodiment of the present invention, however, is not limited to this.

An SOI substrate can be made as follows. Halogen ions such as hydrogen ions and helium ions are implanted by ion implantation or the like in a single crystal silicon substrate, forming a brittle layer in the single crystal silicon substrate. An insulating substrate formed using glass or quartz glass, for example, is superimposed on a single crystal silicon substrate having the brittle layer. The superimposed substrates, i.e. the insulating substrate and the single crystal silicon substrate are heated, so that a part of the single crystal silicon substrate superimposed on the insulating substrate is separated along the brittle layer. Transistors in the display device can be made using such an SOI substrate. One embodiment of the present invention, however, is not limited to this.

In addition, when the above display device has a flexible substrate, it is also possible for a display device according to the present invention to be a flexible display device.

The flexible display device can be made as follows. A release layer is formed over a flexible substrate formed using plastic, resin, or the like. An element formation layer including a transistor and a display element is formed over the release layer. A flexible substrate or flexible film is formed over the element formation layer. The element formation layer is separated from the substrate and the release layer. The method of making the flexible display device is not limited to this.

This embodiment can be combined with any of all the other embodiments.

Embodiment 5

Examples of the electronic appliance using the display device according to the present invention include a video camera, a digital camera, a goggle type display (a head mounted display), a navigation system, an audio reproducing device (a car audio, an audio component and the like), a notebook personal computer, a game machine, a personal digital assistant (a mobile computer, a mobile phone, a portable game console, an electronic book, or the like), an image reproducing device provided with a recording medium (specifically, a device which reproduces a recording medium such as a Digital Versatile Disc (DVD) and which is provided with a display capable of displaying the image). Specific examples of such electronic appliances are shown in FIGS. 12A to 12H.

Figure 12A:
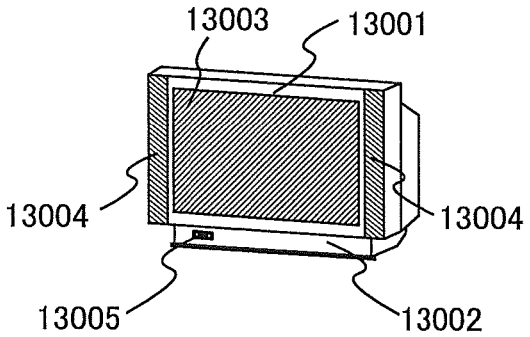
FIGS. 12A to 12H each show an electronic appliance.

FIG. 12A illustrates an information display electronic appliance including a housing 13001, a support 13002, a display portion 13003, a speaker portion 13004, a video input terminal 13005, and the like. The present invention can be used for a display device which forms the display portion 13003. Moreover, the present invention enables the information display electronic appliance shown in FIG. 12A to be completed. As the display portion 13003, an EL display, a liquid crystal display, or the like can be used. Note that the information display electronic appliance is applicable to all types of information display electronic appliance such as those for personal computers, television broadcast reception, and advertisement display.

Figure 12B:
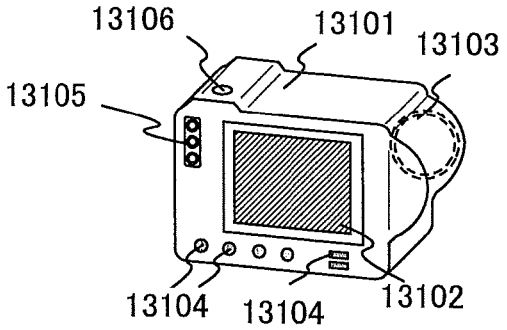

FIG. 12B shows a digital still camera, which includes a main body 13101, a display portion 13102, an image receiving portion 13103, operation keys 13104, an external connecting port 13105, a shutter button 13106, and the like. The present invention can be used for a display device which forms the display portion 13102. The present invention enables the digital still camera shown in FIG. 12B to be completed.

Figure 12C:
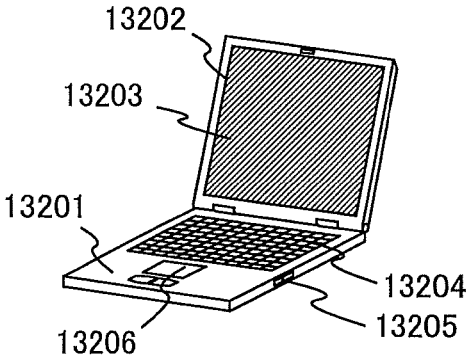

FIG. 12C shows a notebook personal computer including a main body 13201, a housing 13202, a display portion 13203, a keyboard 13204, an external connecting port 13205, a pointing device 13206, and the like. The present invention can be used for a display device which forms the display portion 13203. The present invention enables the notebook personal computer shown in FIG. 12C.

Figure 12D:
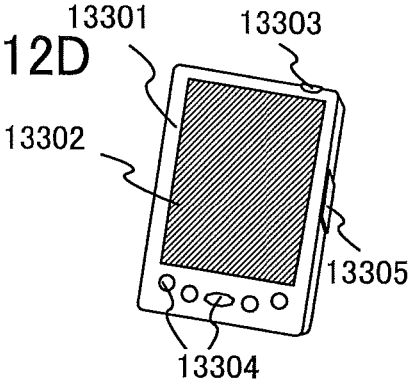

FIG. 12D shows a mobile computer which includes a main body 13301, a display portion 13302, a switch 13303, operation keys 13304, an IR port 13305, and the like. The present invention can be used for a display device which forms the display portion 13302. The present invention enables the mobile computer shown in FIG. 12D to be completed.

Figure 12E:
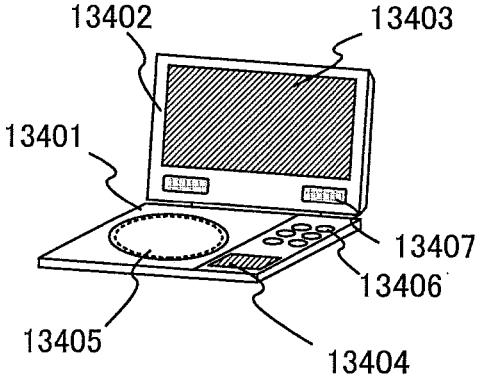

FIG. 12E is a portable image reproducing device provided with a recording medium (specifically, a DVD reproducing device), which includes a main body 13401, a housing 13402, a display portion A 13403, a display portion B 13404, a recording medium (DVD or the like) reading portion 13405, an operating key 13406, a speaker 13407, and the like. The display portion A 13403 mainly displays image data, and the display portion B 13404 mainly displays text data. The present invention can be used for a display device forming the display portion A 13403 or the display portion B 13404. Note that the image reproducing device provided with a recording medium includes a home-use game machine and the like. The present invention enables the image reproducing device shown in FIG. 12E to be completed.

Figure 12F:
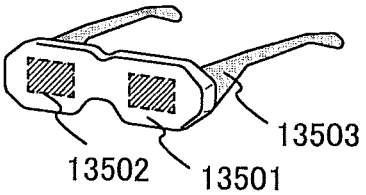

FIG. 12F shows a goggle type display (head mounted display) including a main body 13501, a display portion 13502, an arm 13503, and the like. The invention can be used for a display device which forms the display portion 13502. The present invention enables the goggle type display shown in FIG. 12F to be completed.

Figure 12G:
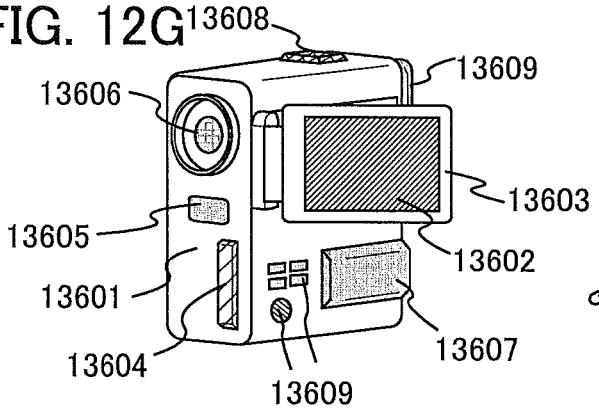

FIG. 12G shows a video camera including a main body 13601, a display portion 13602, a housing 13603, an external connecting port 13604, a remote control receiving portion 13605, an image receiving portion 13606, a battery 13607, an audio input portion 13608, operating keys 13609, and the like. The invention can be used for a display device which forms the display portion 13602. The present invention enables the video camera shown in FIG. 12G to be completed.

Figure 12H:
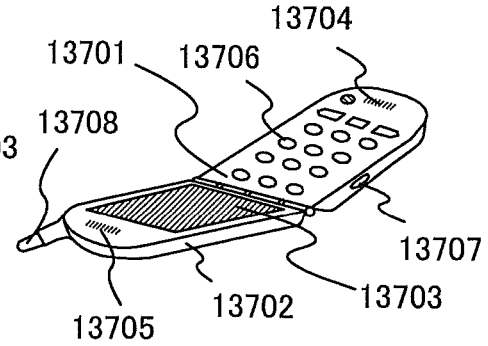

FIG. 12H shows a portable phone including a main body 13701, a housing 13702, a display portion 13703, an audio input portion 13704, an audio output portion 13705, an operation key 13706, an external connecting port 13707, an antenna 13708, and the like. The invention can be used for a display device which forms the display portion 13703. The present invention enables the portable phone shown in FIG. 12H to be completed.

As described above, various types of electronic appliances include a display portion on which image data etc. is displayed. The quality of displayed image data decreases when varies among pixel circuits the threshold voltage of a transistor electrically connected to a display element formed in each pixel circuit of a display device that the display portion has. It is therefore preferable to reduce variations in the threshold voltage of a transistor among pixel circuits. The display device according to the present invention can reduce variations in the threshold voltage of a transistor among pixel circuits.

Therefore, the scope of application of the present invention is extremely wide and the present invention is applicable to all types of electronic appliances. In addition, the electronic appliances of this embodiment can use any structures of the display devices of other embodiments.

This application is based on Japanese Patent Application serial no. 2009-241710 filed with Japan Patent Office on Oct. 20, 2009, the entire contents of which are hereby incorporated by reference.

What is claimed is:

1. A display device comprising:

a transistor;

a capacitor;

a display element comprising a first electrode;

a first switch electrically connected to a gate of the transistor and a first line;

a second switch electrically connected to the gate of the transistor and a first terminal of the transistor;

a third switch electrically connected to the gate of the transistor and a second line; and a fourth switch electrically connected to the first terminal of the transistor and a third line, wherein one electrode of the capacitor is directly connected to the first terminal of the transistor, wherein the other electrode of the capacitor is directly connected to the gate of the transistor, wherein the first electrode of the display element is directly connected to a second terminal of the transistor, and wherein the fourth switch is configured to control electrical connection between the one electrode of the capacitor and the third line and electrical connection between the first terminal of the transistor and the third line.

2. The display device according to claim 1, wherein the display element is an EL element.

3. The display device according to claim 1, wherein the display element is a liquid crystal element.

4. The display device according to claim 1, wherein the transistor comprises an oxide semiconductor layer.

5. The display device according to claim 1, wherein the transistor is a p-channel transistor.

6. The display device according to claim 1, wherein the first electrode of the display element is larger than the one electrode of the capacitor, and wherein capacitance of the display element is larger than capacitance of the capacitor.

7. The display device according to claim 1, wherein the first switch, the second switch, the third switch and the fourth switch are transistors.

8. The display device according to claim 1, wherein the first switch, the second switch, the third switch and the fourth switch are diodes.

9. An electronic appliance comprising the display device according to claim 1.

* * * * *